US011030908B2

(12) United States Patent
Maddanimath

(10) Patent No.: US 11,030,908 B2
(45) Date of Patent: Jun. 8, 2021

(54) SYSTEM AND METHOD FOR IDENTIFICATION AND ASSESSMENT OF ABNORMAL BEHAVIOR OF NEARBY AIRCRAFT

(71) Applicant: Rockwell Collins, Inc., Cedar Rapids, IA (US)

(72) Inventor: Shivashankar Veerayya Maddanimath, Bangalore (IN)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 16/113,824

(22) Filed: Aug. 27, 2018

(65) Prior Publication Data

US 2019/0355265 A1 Nov. 21, 2019

(30) Foreign Application Priority Data

May 17, 2018 (IN) ..... 201811018526

(51) Int. Cl.
*G08G 5/04* (2006.01)
*G08G 5/00* (2006.01)

(52) U.S. Cl.
CPC ..... *G08G 5/04* (2013.01); *G08G 5/0008* (2013.01)

(58) Field of Classification Search
CPC ..... G08G 5/04; G08G 5/0008; G08G 5/0021; G08G 5/0086; G08G 5/025; G08G 5/0034; G08G 5/0039; G01C 23/005; G01C 21/005; B64D 43/00; B64D 43/02; B64D 45/04; B64D 45/08
See application file for complete search history.

(56) References Cited

U.S. PATENT DOCUMENTS 6,995,689 B2 * 2/2006 Crank ..... B64D 45/0015 340/970
8,914,164 B1 * 12/2014 Nathan ..... G01P 3/50 701/7
2002/0032528 A1 * 3/2002 Lai ..... G08G 5/0008 701/301
2003/0233192 A1 * 12/2003 Bayh ..... G08G 5/0078 701/301
2009/0138138 A1 * 5/2009 Ferren ..... G05D 1/0676 701/3
2010/0152932 A1 * 6/2010 Das ..... G08G 5/0078 701/14
2011/0224847 A1 * 9/2011 Singer ..... G01C 23/00 701/4
2013/0226376 A1 * 8/2013 Shamasundar ..... G08G 5/0021 701/14

(Continued)

*Primary Examiner* — Hai Phan
*Assistant Examiner* — Anthony D Afrifa-Kyei
(74) *Attorney, Agent, or Firm* — Kinney & Lange, P.A.

(57) ABSTRACT

A system includes a communication interface configured to receive squitter messages from other aircraft in the vicinity of an ownship aircraft. The system also includes a processor aboard the ownship configured to receive the squitter messages, determine the altitude and position of the other aircraft from the squitter messages, and compare the altitude of the other aircraft to terrain data at the determined position to determine whether any of the other aircraft are operating abnormally. The system also includes a display providing an indication that a first aircraft of the other aircraft is operating abnormally.

23 Claims, 7 Drawing Sheets

(56) References Cited

U.S. PATENT DOCUMENTS

| | | | | |
|---|---|---|---|---|
| 2014/0343765 | A1* | 11/2014 | Suiter | G08G 5/0021 701/18 |
| 2015/0088342 | A1* | 3/2015 | Conner | G01W 1/10 701/14 |
| 2016/0381596 | A1* | 12/2016 | Hu | H04B 7/18504 370/236 |
| 2019/0020572 | A1* | 1/2019 | Hu | H04L 45/08 |
| 2019/0043369 | A1* | 2/2019 | Miller | H04W 4/029 |
| 2019/0162555 | A1* | 5/2019 | Youssef | G08G 5/0021 |

* cited by examiner

200

SYSTEM AND METHOD FOR IDENTIFICATION AND ASSESSMENT OF ABNORMAL BEHAVIOR OF NEARBY AIRCRAFT

CROSS-REFERENCE TO RELATED PATENT APPLICATIONS

The present application claims the benefit and priority to India Application Serial No. 201811018526, filed on May 17, 2018, entitled "SYSTEM AND METHOD FOR IDENTIFICATION AND ASSESSMENT OF ABNORMAL BEHAVIOR OF NEARBY AIRCRAFT", which is incorporated herein by reference in its entirety.

BACKGROUND

Embodiments of inventive concepts disclosed herein relate generally to detection of suspicious or abnormal vehicle operation including but not limited to suspicious or abnormal aircraft operation related to controlled flight into terrain (CFIT).

Pilots can mistakenly or intentionally fly aircraft too close to a body of water (e.g., oceans, sea, lake, dam, back water, rivers, etc.) or terrain. Flying too close to the ground can result in a crash into a body of water or terrain and/or CFIT. Detection of aircraft that are operating in a suspicious or abnormal fashion may allow the pilot or authorities to be contacted to avoid or mitigate catastrophic results.

SUMMARY

In one aspect, the inventive concepts disclosed herein are directed to an apparatus for sensing that a first aircraft in the vicinity of a second aircraft is flying too close to water or terrain or on an improper path toward the water or terrain. The apparatus includes a processor and a display. The processor is disposed on board the second aircraft and is configured to receive a message from the first aircraft. The message includes flight data for the first aircraft. The processor is further configured to use the flight data and terrain data to determine whether the first aircraft is flying too close to water or terrain or on an improper path toward the water or terrain. The display provides an indication of whether the first aircraft is flying too close to water or terrain or on an improper path toward the water or terrain.

In a further aspect, the inventive concepts disclosed herein are directed to a method of detecting abnormal flight behavior of a first aircraft in the vicinity of a second aircraft. The method includes receiving a message on the second aircraft from the first aircraft, the message comprising flight data for the first aircraft, using the flight data and terrain data to determine whether the first aircraft is flying too close to water or terrain or on an improper path toward the ground, and providing the flight data to a flight data recorder if the first aircraft is flying too close to water or terrain or on an improper path toward the water or terrain.

In a further aspect, the inventive concepts disclosed herein are directed to a system. The system includes a communication interface configured to receive squitter messages from other aircraft in the vicinity of an ownship aircraft. The system also includes a processor aboard the ownship configured to receive the squitter messages, determine the altitude of the other aircraft from the squitter messages, and compare the altitude of the other aircraft to terrain data to determine whether any of the other aircraft are operating abnormally. The system can also include a display providing an indication that a first aircraft of the other aircraft is operating abnormally.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION

Figure 1:
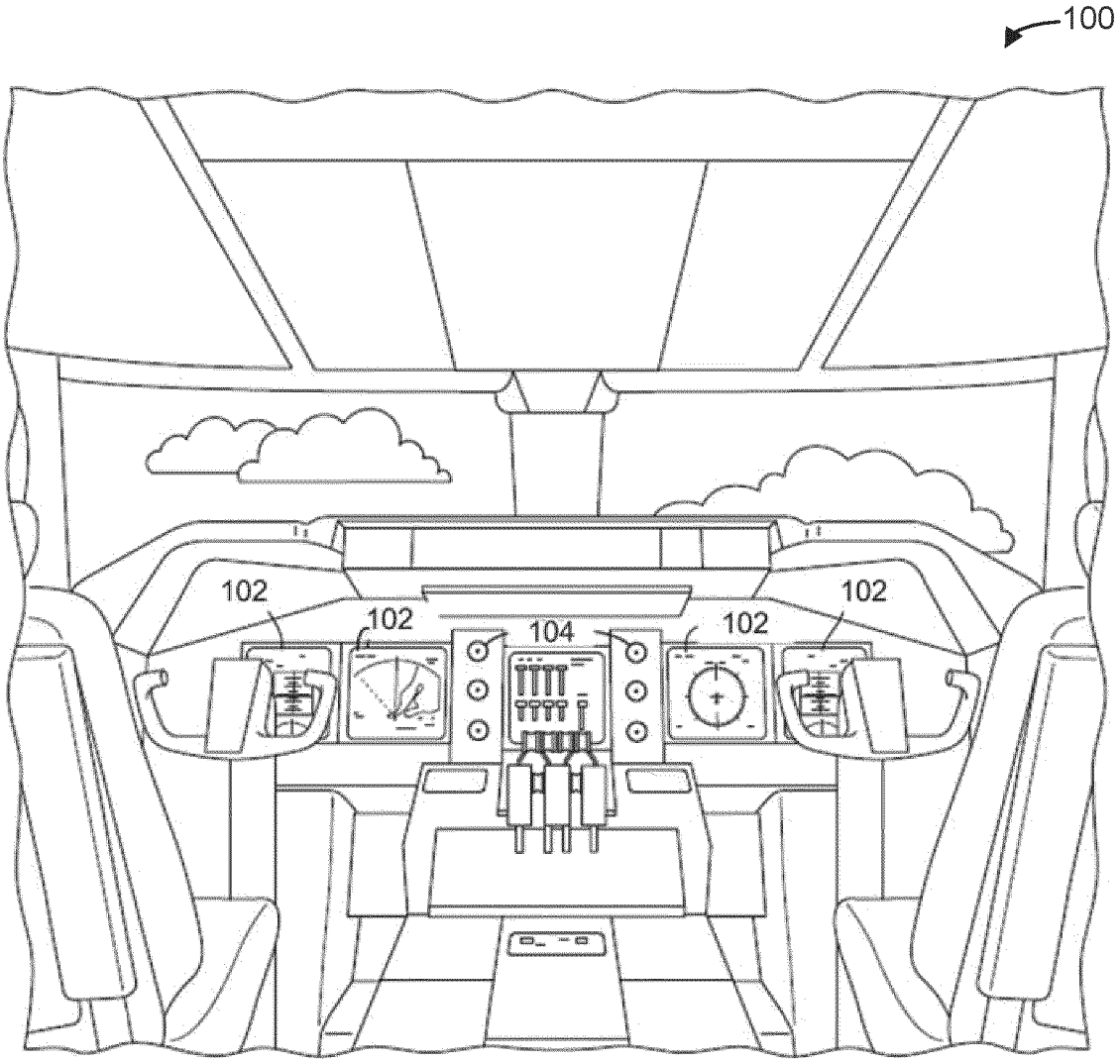
FIG. 1 is a schematic illustration of an exemplary embodiment of a control center of an aircraft, according to the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein, a letter following a reference numeral is intended to reference an embodiment of the feature or element that may be similar, but not necessarily identical, to a previously described element or feature bearing the same reference numeral (e.g., 1, 1a, 1b). Such shorthand notations are used for purposes of convenience only and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" is employed to describe elements and components of embodiments of the instant inventive concepts. This is done merely for convenience and to give a general sense of the inventive concepts, and "a" and "an" are intended to include one or at least one, and the singular also includes the plural unless it is obvious that it is meant otherwise.

Finally, as used herein any reference to "one embodiment" or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination or sub-combination of two or more such features, along with any other features which may not necessarily be expressly described or inherently present in the instant disclosure.

Broadly, embodiments of the inventive concepts disclosed herein are directed to identification and assessment of abnormal behavior of a nearby aircraft. The inventive concepts disclosed herein can be utilized in a number of control and alerting systems for various types of applications, sensing systems, and display systems. While the present disclosure describes systems and methods implementable in an aircraft, the inventive concepts disclosed herein may be used in any type of environment, such as another aircraft, a spacecraft, an unmanned aircraft (e.g., a drone), a ground-based vehicle, or in a non-vehicle application such as a ground-based display system, an air traffic control system, a radar system, a virtual display system, etc. While certain examples and embodiments of the inventive concepts disclosed herein are described with respect to a pilot of an aircraft, it will be appreciated that users other than a pilot may use and benefit from the inventive concepts disclosed herein with respect to other vehicles and/or objects.

In some embodiments, systems and methods can be employed to sense or detect abnormal aircraft behavior (e.g., flying too close to water or terrain or on an improper path toward the ground) using equipment aboard other aircraft in the vicinity. Personnel (e.g., the pilots) aboard the other aircraft in the vicinity can contact the aircraft via radio or other communication device (pilots tune to some common available frequency) to assist when they are made aware that the aircraft in vicinity is performing suspicious/abnormal operations in some embodiments. In some embodiments, the systems and methods can be employed using other aircraft to sense or detect that an aircraft in vicinity is performing suspicious/abnormal operations and alert authorities. In some embodiments, the systems and methods can be employed using other aircraft to record flight data associated with an aircraft in vicinity that is performing suspicious/abnormal operations. The flight data can be provided to authorities for analysis of the incident. Further, such information can assist the location of an aircraft that has crashed or had an unplanned landing. The systems and methods assist airlines in knowing of aircraft having a possible CFIT, being en route to CFIT, and or having an unplanned landing and arrange for necessary help and rescue.

Referring now to FIG. 1, a schematic illustration of an exemplary embodiment of a control center of an aircraft is shown according to the inventive concepts disclosed herein. The aircraft control center 100 (or "cockpit") includes one or more flight displays 102 and one or more user interface (UI) elements 104. The flight displays 102 may be implemented using any of a variety of display technologies, including CRT, LCD, organic LED, dot matrix display, and others. The flight displays 102 may be navigation (NAV) displays, primary flight displays, electronic flight bag displays, tablets such as iPad® computers manufactured by Apple, Inc., or tablet computers, synthetic vision system displays, head up displays (HUDs) with or without a projector, wearable displays, watches, Google Glass®, etc. The flight displays 102 may be used to provide information to the flight crew, thereby increasing the flight crew's visual range and enhancing their decision-making abilities. The flight displays 102 may be configured to function as, for example, a primary flight display (PFD) used to display altitude, airspeed, vertical speed, navigation, and traffic collision avoidance system (TCAS) advisories; a crew alert system (CAS) configured to provide alerts to the flight crew; a multi-function display used to display navigation maps, weather radar, electronic charts, TCAS traffic, aircraft maintenance data, and electronic checklists, manuals, and procedures; an engine indicating and/or crew-alerting system (EICAS) display used to display critical engine and system status data. Other types and functions of the flight displays 102 are contemplated and will be apparent to those skilled in the art. According to various exemplary embodiments of the inventive concepts disclosed herein, at least one of the flight displays 102 may be configured to provide a rendered display from the systems and methods described herein.

In some embodiments, systems and methods sense or detect that an aircraft in the vicinity is flying abnormally (e.g., too close to the ground (e.g., water or terrain) or on an improper path toward the ground) and provide such information on the one or more flight displays 102. The flight displays 102 provide an output from an aircraft-based system, a ground-based system, a satellite-based system, or from a system of another aircraft. In some embodiments, the flight displays 102 provide the information on a traffic collision avoidance (TCAS) display or Automatic Dependent Surveillance (ADS) display (e.g., a broadcast (ADS-B) or re-broadcast (ADS-R) display) and include an interface element of the UI elements 104 for sending a panic or Mayday message. For example, the flight displays 102 may include an avionics display, a joint display, an air traffic display, a weather radar map, and a terrain display configured to provide information related to aircraft in the vicinity that are flying too close to water or terrain or on an improper path toward the ground and include information about the aircraft (e.g., identification, location, call sign, speed altitude, etc.)

The views shown on the flight displays 102 may include monochrome or color graphical representations of the displayed information, which may include an indication of altitude of other aircraft, weather conditions, or terrain, or the altitude and/or location of such information relative to the aircraft, as well as the information related to the aircraft that is flying too close to water or terrain or on an improper path toward the ground. In some embodiments, the views on the flight displays 102 can include a two-dimensional visualization depicting nearby objects and/or aircraft. In some embodiments, the two-dimensional visualization can be arranged so the nearby objects and/or aircrafts, according to a horizontal vector of the nearby objects and aircrafts, are relative to the control center 100.

The UI elements 104 may include, for example, dials, switches, buttons, touch screens, keyboards, a mouse, joysticks, cursor control devices (CCDs), or other multi-function key pads certified for use with avionics systems. The UI elements 104 may be configured to, for example, allow an aircraft crew member to interact with various avionics applications and perform functions such as data entry, manipulation of navigational maps, and moving among and selecting checklist items. For example, the UI elements 104 may be used to make radio contact with the aircraft that is flying too close to water or terrain or on an improper path toward the ground, send a panic or Mayday message (including information about the suspicious aircraft), or select other display information or display formats for the information. The UI elements 104 may also (or alternatively) be used by an aircraft crew member to interface with or manipulate the displays of the flight displays 102. Other UI elements 104, such as indicator lights, displays, display elements, and audio alerting devices, may be configured to warn of potentially threatening conditions such as severe weather, terrain, and obstacles or that an aircraft that is flying too close to water or terrain or on an improper path toward the ground.

In some embodiments, the UI elements 104 may additionally be used for receiving a user input in response to an indicator provided by the flight displays 102. In some embodiments, at least one of the UI elements 104 and the flight displays 102 can be configured to provide a touch-screen user interface. The touch-screen user interface can be configured to provide a two-dimensional visualization of nearby objects and aircrafts, which may be arranged according to lateral distance of the nearby objects and aircrafts relative to the control center 100. For example, the touch-screen user interface can be configured with one or more touch-sensitive buttons, and in this regard, a user can provide a user input (e.g., a touch gesture) indicating a selection of a touch-sensitive button. The touch-screen user interface can be configured to receive the user input and pass the user input to a processing circuit or perform any other responsive actions.

Figure 2:
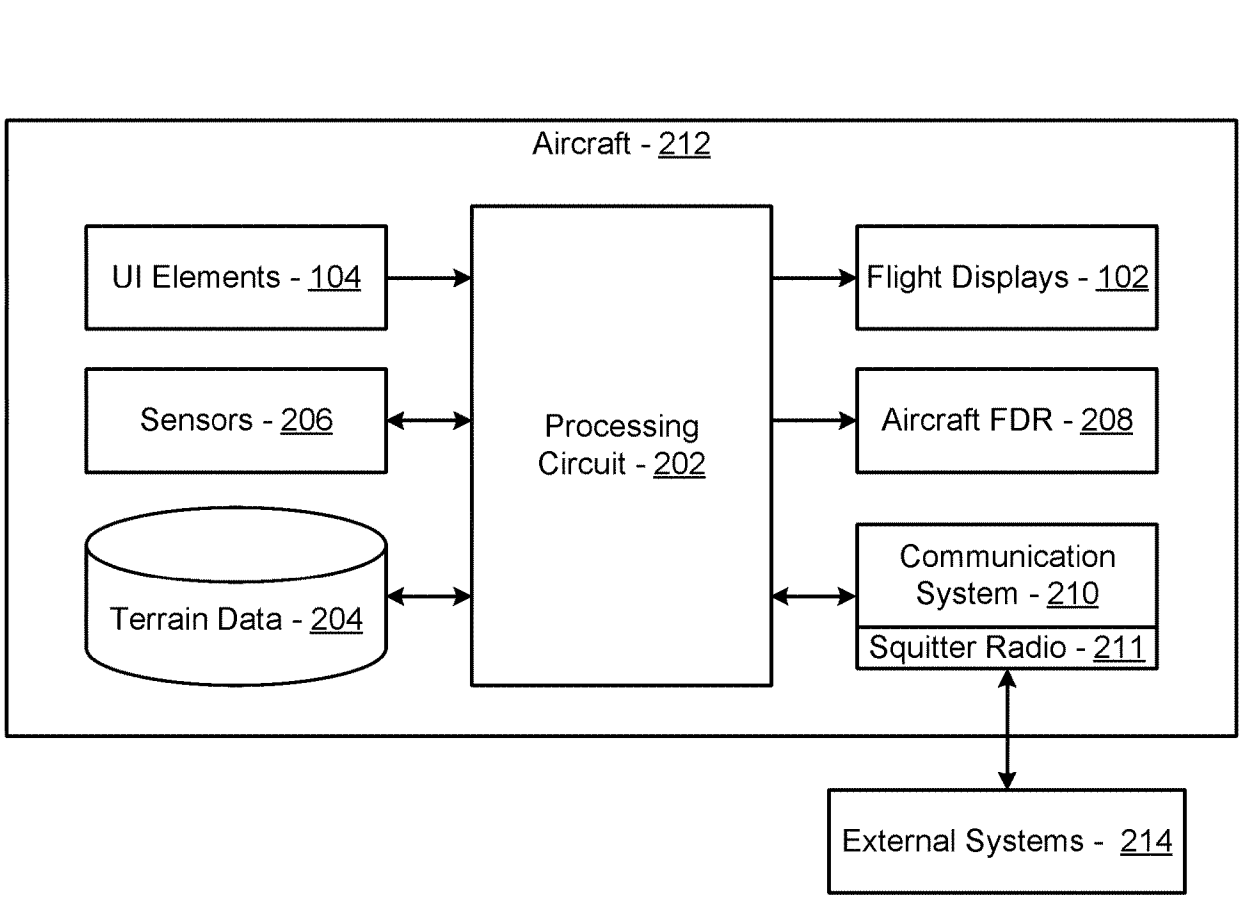
FIG. 2 is block diagram of an exemplary embodiment of a system configured for identification and assessment of abnormal behavior of a nearby aircraft, according to the inventive concepts disclosed herein.

Referring now to FIG. 2, a system 200 configured to detect or sense that an aircraft is flying too close to water or terrain or on an improper path toward the ground, the display is shown according to the inventive concepts disclosed herein. In some embodiments, the system 200 includes a processing circuit 202, the flight displays 102, the UI elements 104, sensors 206, a flight data recorder (FDR) 208, and a communication system 210 provided in an aircraft 212 (or an "airborne platform"). In some embodiments, one or more of the processing circuit 202, the flight displays 102, the UI elements 104, the sensors 206, and the communication system 210 is integrated with or provided as part of another aircraft system, such as a synthetic vision system (SVS), a flight management computer, a TCAS, a primary flight display, a navigation system, an electronic flight bag, or other system. In some embodiments, one or more of the processing circuit 202, the flight displays 102, the UI elements 104, the sensors 206, and the communication system 210 is provided external to the aircraft 212. In some embodiments, the system 200 includes other systems and components for general aircraft operation, such as a weather radar system, an SVS, TCAS, Automatic Dependent Surveillance ADS system, or other avionic equipment.

In some embodiments, the communication system 210 is a wireless communication system, such as, an avionic radio system including one or more of a very high frequency (VHF), ultra high frequency (UHF), satellite communication, data radios, and/or other communications systems. In some embodiments, the communication system 210 includes a squitter radio system 211 for use with TCAS and ADS systems (e.g., broadcast (ADS-B) or re-broadcast (ADS-R)). In some embodiments, the squitter radio system 211 is a mode S transponder configured as described herein. The squitter radio system 211 (e.g., an ADS-B IN transponder) is configured to receive extended squitter messages that provide position, velocity, status, and identifier information broadcast from aircraft in the vicinity. The extended squitter message can be sent using transponders (including, for example, ADS-B OUT, Mode S, Universal Access Transceiver (UAT), and VHF Data Link (VDL) mode 4) and provide transmissions at regular intervals.

The extended squitter message is a radio frequency (RF) signal that is periodically generated by the radio-based transponder and broadcast for reception by both ground and aircraft systems that want to monitor and track the emitting aircraft's state. The extended squitter message is received from external systems 214 such as transponders on other aircraft or equipment. In some embodiments, the external systems 214 are other radio units such as UHF, VHF, and satellite communication voice and data radios. In some embodiments, the extended squitter message includes aircraft position, direction of flight, airborne velocity, vertical climb/descent, and other information provided by a global positioning system (GPS) navigation system onboard the aircraft in the vicinity.

The processing circuit 202 is a computing platform, such as an aviation computing resource (e.g., a traffic computer, surveillance system, integrated avionics module, or common computer module), a general purpose processor, an electronic flight bag, or a portable device. The processing circuit 202 is configured by software stored on a non-transitory medium to provide the operations described herein. In some embodiments, processing circuit 202 advantageously receives information from a variety of sources including the sensors 206, the terrain database 204, the UI elements 104, and the squitter radio system 211 to provide information to the flight displays 102 and the FDR 208 and for communications via the communication system 210.

In some embodiments, the processing circuit 202 is configured by a software module to receive messages from one or more aircraft in the vicinity. The processing circuit 202 is onboard the aircraft 212 and processes the information in each message to determine that an aircraft is flying too close to water or terrain or is on an improper path toward the ground in some embodiments. In some embodiments, the processing circuit 202 is configured to process an ADS-B IN extended squitter message received from different aircrafts in local airspace and use the information from the message in conjunction with terrain database 204 to detect suspicious/abnormal behavior of aircraft in the vicinity and inform the pilot of the aircraft 212 to intervene. The detection is made in real time or almost real time (e.g., in several seconds). The processing circuit 202 can also use information from the sensors 206 and other information received from the communication system 210 in some embodiments.

In some embodiments, the processing circuit 202 uses barometric altitude, aircraft position, direction of flight, airborne velocity, and vertical climb/descent from the extended squitter message and compares a flight path derived therefrom to terrain data in the terrain database 204, which is onboard the aircraft 212 in some embodiments. Terrain avoidance warning system (TAWS) algorithms can be used to determine if aircraft is flying too low on sea, land, or terrain or if the risk of CFIT is unacceptable. In some embodiments, a degraded version of TAWS instances is used for the warnings. In some embodiments, the processing circuit 202 does not issue the warning if there is a runway towards which the aircraft which is otherwise too low is headed. The terrain database 204 provides the runway information, such as runway direction of landing and location. If there is no runway in range justifying low altitude of aircraft, then the processing circuit 202 issues the warning to the flight display 102 (e.g., by displaying the aircraft with a unique representation) in some embodiments. In some embodiments, the warning is not issued if there is an airport or runway in the proximity of the aircraft 212 (e.g., an airport or runway within the display area, within 10 nautical miles, etc.). In some embodiments, the proximity threshold for the runway is related to the closeness to the terrain (e.g., the lower the altitude the closer the runway should be to prevent the alert from being provided).

A pilot can click (or otherwise select) using the UI elements 104 (FIG. 2) to send a controller pilot down link (CPDL) message (Panic/Mayday) indicating a selected aircraft is exhibiting abnormal/suspicious behavior via the communication system 210 (FIG. 2). The message includes the other aircraft's identification (e.g., call sign), other aircraft's flight data (e.g., altitude, aircraft position, direction of flight, airborne velocity, and vertical climb/descent), the sending aircraft's identification, and the sending aircraft's flight data. The other aircraft's identification, other aircraft's flight data, the sending aircraft's identification, and the sending aircraft's flight data are logged into the FDR 208 (e.g., automatically). The pilot of the aircraft 212 can reach out to the pilot of aircraft flying low/into terrain over an available radio frequency and inform/relay the same manually to air traffic control (ATC) or an area controller via the communication system 210. In some embodiments, the processing circuit 202 provides the message to ATC or the area controller automatically upon detecting that an aircraft is flying abnormally.

The terrain database 204 is a geographic database stored in memory and includes altitude of terrain and structures at locations on the Earth in some embodiments. The terrain database 204 is a Jeppesen terrain or other source database in some embodiments. In some embodiments, the terrain database 204 is an industry standard or proprietary database. The FDR 208 is a storage device for storing flight data. The terrain database 204 and the FDR 208 can be an electronic memory or disk drive in some embodiments.

The sensors 206 include one or more global navigation satellite system (GNSS), flight management system (FMS), long range navigation (LORAN) system, inertial reference system (IRS), distance measuring equipment (DME) system, an altimeter, compass, flight speed indicator, or other systems that are used to determine aircraft state, including any combination thereof. GNSS systems include GPS, global navigation satellite system (GLONASS), Galileo, etc., and may also include one or more augmentation system (e.g., satellite based augmentation system (SBAS), ground-based augmentation system (GBAS), or ground-based regional augmentation system (GRAS)).

Figure 3:
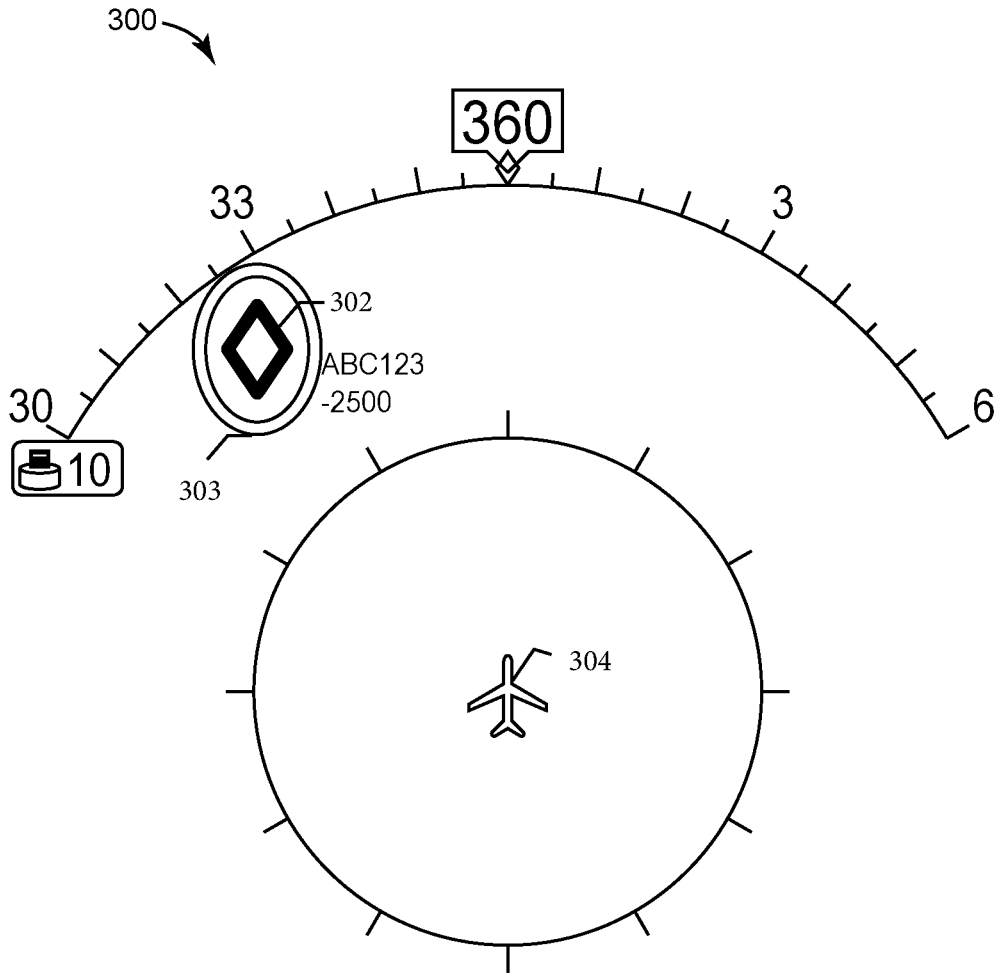
FIG. 3 is an example screenshot of a display provided on an aircraft display device, according to the inventive concepts disclosed herein.

With reference to FIG. 3, a display 300 on the flight display 102 (FIG. 2) includes an icon 302. A circle 303 around the diamond shape of the icon 302 is an indication that an aircraft in the vicinity of the aircraft including the flight display 102 is flying too close to water or terrain or is on an improper path toward the ground. The circle 303 indicates that the aircraft is too low and that there is not a nearby runway in some embodiments. The location of the aircraft represented by the icon 302 is shown relative to the aircraft 212 (FIG. 2) including the flight display 102 (the icon 304). The display 300 can include azimuth markings and range lines to assist location of the aircraft represented by the icon 302. Text next to the icon 302 indicates the identification of the aircraft and its altitude. The color of the circle 303 is red, amber, or orange and the color of the icon is 302 is green, purple, white, or black in some embodiments. Other shapes and colors can be utilized, including but not limited to triangles, chevrons, plane-shaped icons, etc. In some embodiments, the display 300 provided as part of a TCAS display, a primary flight display, a navigation display, an electronic flight bag display, or other avionic display.

Figure 4:
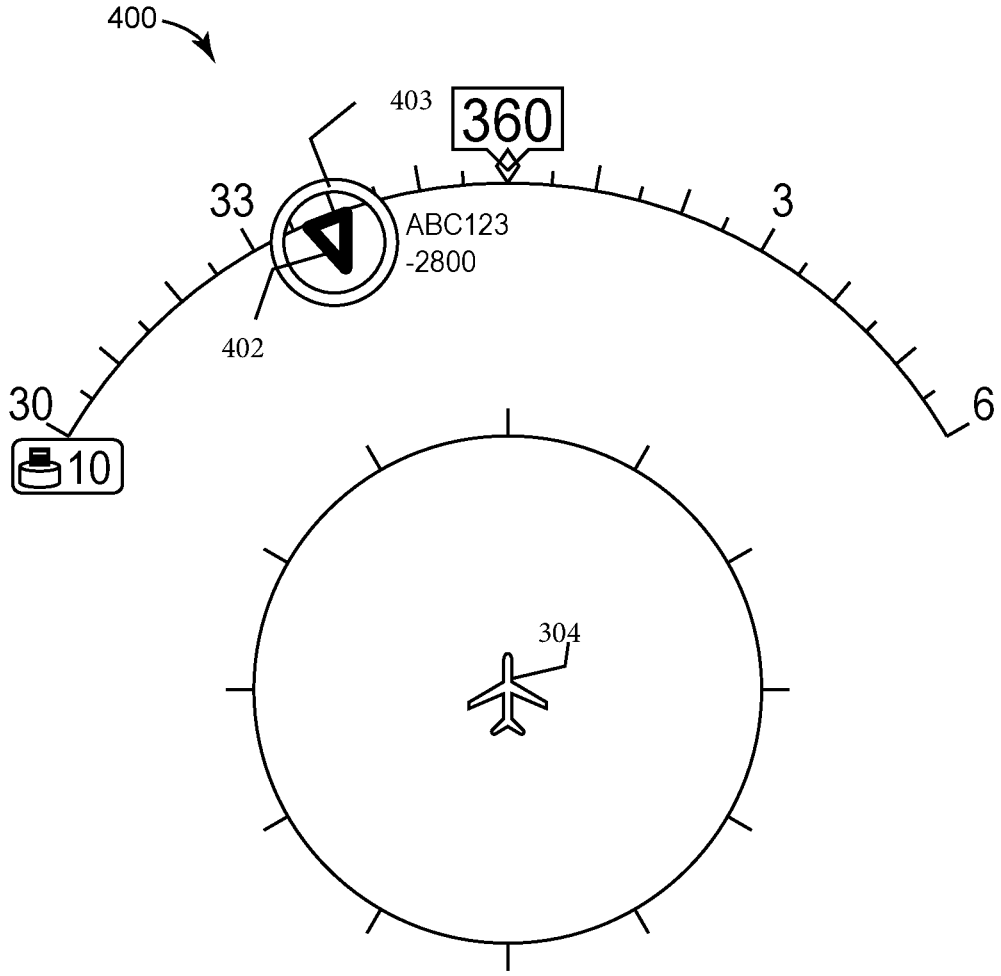
FIG. 4 is another example screenshot of a display provided on an aircraft display device, according to the inventive concepts disclosed herein.

With reference to FIG. 4, a display 400 on the flight display 102 (FIG. 2) includes an icon 402. A circle 403 around the icon 402 is an indication that an aircraft in the vicinity of the aircraft including the flight display 102 is flying too close to water or terrain or is on an improper path toward the ground. The triangle shape of the icon 402 is a result of the aircraft almost being out of range of the display 400. The circle 403 indicates that the aircraft is too low and that there is not a nearby runway in some embodiments. The location of the aircraft represented by the icon 402 is shown relative to the aircraft including the flight display 102 (the icon 304). Text next to the icon 402 indicates the identification of the aircraft and its altitude. The color of the circle 403 is red, amber, or orange and the color of the icon is 402 is white or black in some embodiments. Other shapes and colors can be utilized including but not limited to triangles, chevrons, plane-shaped icons, etc. In some embodiments, the display 400 is a TCAS display.

Figure 5:
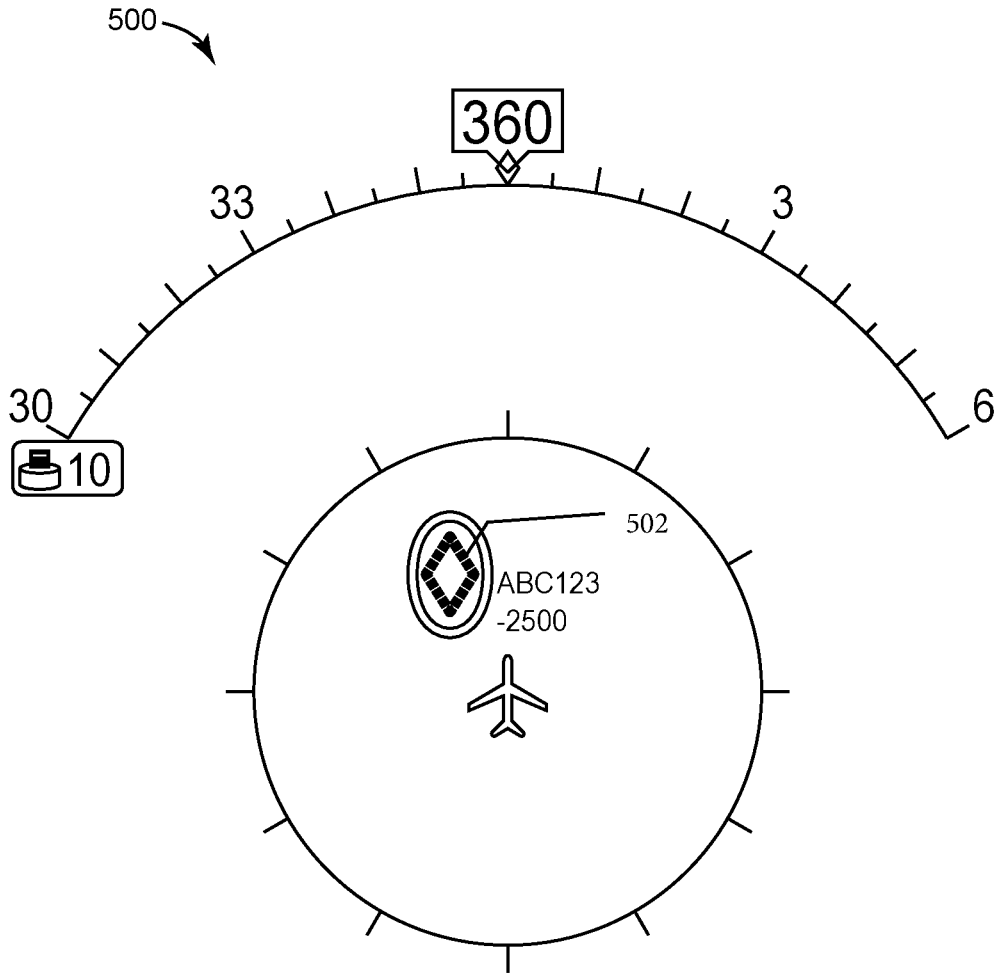
FIG. 5 is another example screenshot of a display provided on an aircraft display device, according to the inventive concepts disclosed herein.

With reference to FIG. 5, a display 500 on the flight display 102 (FIG. 2) includes an icon 502. The dotted outline of the icon 502 is an indication that an aircraft in the vicinity of the aircraft including the flight display 102 is flying too close to water or terrain or is on an improper path toward the ground. In some embodiments, the icon 502 is highlighted, dashed, reverse toggled, colored, or otherwise accentuated to indicate the warning.

Figure 6:
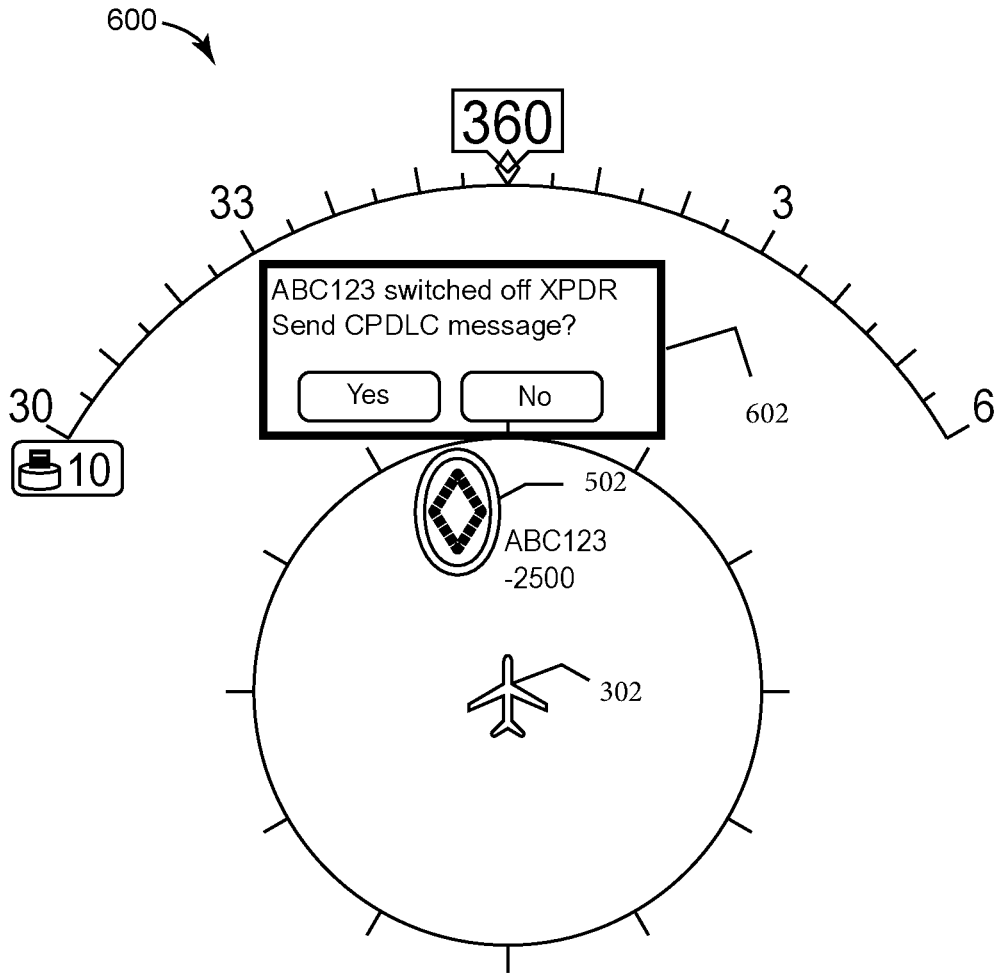
FIG. 6 is another example screenshot of a display provided on an aircraft display device, according to the inventive concepts disclosed herein.

With reference to FIG. 6, a display 600 on the flight display 102 (FIG. 2) includes the icon 502. The dotted outline of the icon 502 is an indication that an aircraft in the vicinity of the aircraft 212 (FIG. 2) including the flight display 102 (the icon 302) is flying too close to water or terrain or is on an improper path toward the ground. In some embodiments, a message 602 is provided if the transponder for the aircraft represented by the icon 502 is no longer providing a squitter message. In some embodiments, the message 602 is provided if the transponder for the aircraft represented by the icon 502 is no longer providing a squitter message after the processing circuit 202 (FIG. 2) has determined that the aircraft is flying too close to water or terrain or is on an improper path toward the ground. The message 602 can provide an option for the pilot to send a CPLD message. In some embodiments, the message 602 indicates that a CFIT may have occurred and provides the identification of the aircraft associated with the icon 502. The processing circuit 202 (FIG. 2) determines that the transponder is not working when the squitter message is no longer received by the squitter radio system 211 in some embodiments.

Figure 7:
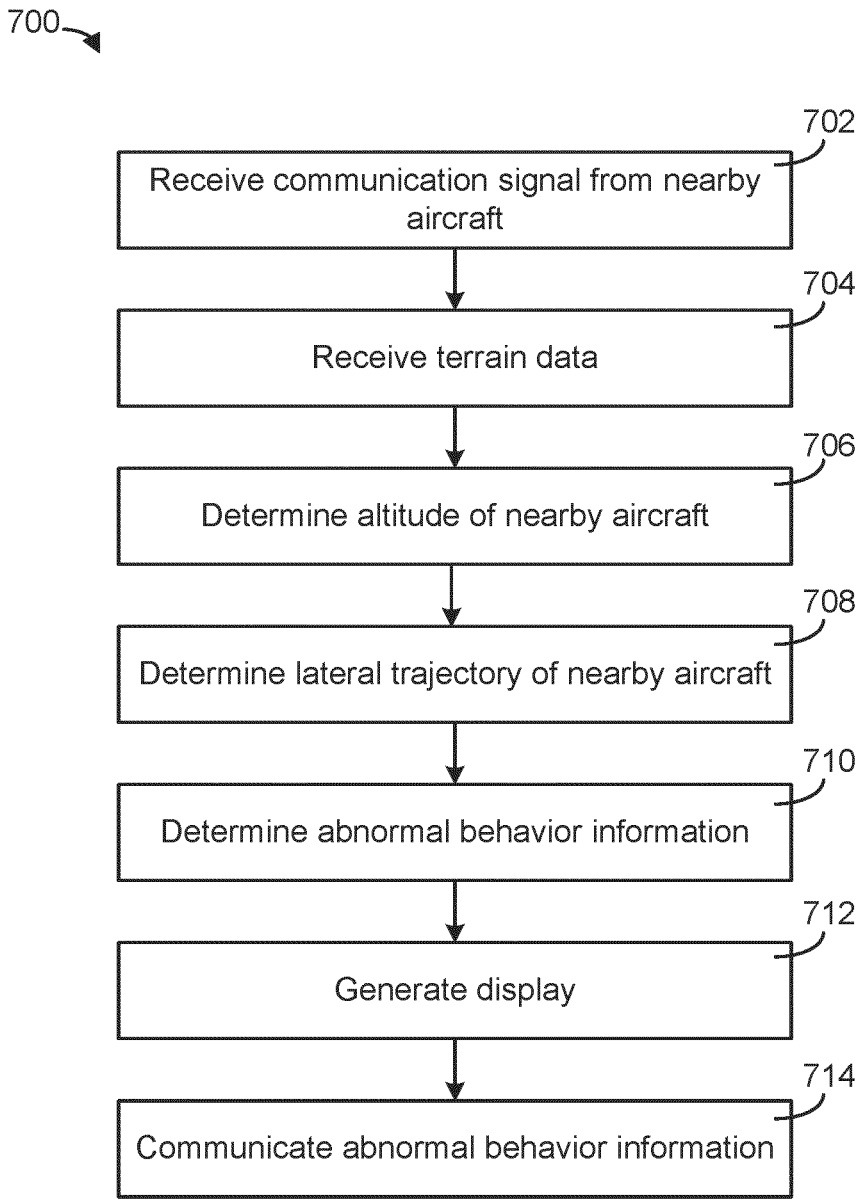
FIG. 7 is a flow diagram of an exemplary embodiment of a process for identification and assessment of abnormal behavior of a nearby aircraft, according to the inventive concepts disclosed herein.

With reference to FIG. 7, the processing circuit 202 operates according to a flow 700 in some embodiments. At an operation 702, the processing circuit 202 receives communication (e.g., extended squitter messages) from nearby aircraft via the communication system 210. At an operation 704, the processing circuit 202 receives terrain data associated with the location of the aircraft. The location of each aircraft is included in its squitter message or is calculated based upon relative locations from the aircraft in some embodiments. At an operation 706, the processing circuit 202 determines the altitude of the nearby aircraft. The altitude of each aircraft is included in its squitter message in some embodiments.

At an operation 708, the processing circuit 202 determines the lateral and/or vertical trajectory of each aircraft. The lateral and vertical trajectory can be determined from the flight data. The trajectory of each aircraft and its position is compared to the terrain data to determine if abnormal flight behavior exists in an operation 710 by the processing circuit 202. In some embodiments, a TAWS algorithm is used to determine if the abnormal flight behavior exists. Criteria for such a determination include one or more of the following in some embodiments:

1. Low altitude without being on a flight path to a runway.
2. Flight path directed to terrain unless on flight path to the runway.
3. Flight path intersects buffer zone above terrain.
4. Downward vertical speed is above threshold.
5. Erratic flight path.
6. Very high descent/sink rate.

Other criteria and TAWS algorithms can be used to determine if the abnormal flight behavior exists or if an aircraft in the vicinity of the aircraft including the flight display 102 is flying too close to water or terrain or is on an improper path toward the ground.

It is to be understood that embodiments of the methods according to the inventive concepts disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

What is claimed is:

1. An apparatus for sensing if a first aircraft in vicinity of a second aircraft is flying too close to water or terrain, the apparatus comprising:

a communication system on board the second aircraft configured to receive a message from the first aircraft, the message comprising real-time flight data of the first aircraft;

a processor configured to use the real-time flight data from the first aircraft and both terrain data and runway data obtained from a terrain database on board the second aircraft to determine whether the first aircraft is flying too close to the water or terrain without being on a flight path towards a runway; and a display on board the second aircraft, the display providing, in response to the processor, a warning indication that the first aircraft is flying too close to the water or terrain without being on the flight path towards a runway; and a flight data recorder on board the second aircraft that stores the real-time flight data of the first aircraft when the processor has determined that the first aircraft is flying too close to the water or terrain or on an improper path toward the water or terrain.

2. The apparatus of claim 1, wherein the processor utilizes a Terrain Avoidance Warning System (TAWS) algorithm.

3. The apparatus of claim 1, wherein the indication is provided as part of Traffic Information Service-Broadcast (TIS-B), Automatic Dependent Surveillance-Broadcast (ADS-B), Automatic Dependent Surveillance-Re-broadcast (ADS-R), and Traffic Collision Avoidance System (TCAS), or any combination thereof indications.

4. The apparatus of claim 1, wherein the real-time flight data of the first aircraft comprises at least one of altitude, aircraft position, direction of flight, airborne velocity, vertical climb/descent, and identification of the first aircraft.

5. The apparatus of claim 1, wherein the warning indication is a highlighted icon on a Traffic Collision Avoidance System (TCAS) display, a primary flight display, a navigation display, or an electronic flight bag display.

6. The apparatus of claim 1, wherein the processor is further configured to provide a user interface element configured to send a message that the first aircraft is flying too close to the water or terrain or on an improper path toward the water or terrain upon user selection.

7. The apparatus of claim 1, wherein the processor is further configured to provide a user interface element configured to send a message that the first aircraft is flying too close to the water or terrain or on an improper path toward the water or terrain upon user selection in response to a squitter signal not being received from the first aircraft after determining that the first aircraft is flying too close to the water or terrain or on an improper path toward the water or terrain upon user selection.

8. A method of detecting abnormal flight behavior of a first aircraft in vicinity of a second aircraft, the method comprising:

receiving, with a communication system on board the second aircraft, a message from the first aircraft, the message comprising an aircraft identification and real-time flight data of the first aircraft;

detecting abnormal flight behavior of the first aircraft using a processor on-board the second aircraft, wherein the processor uses the aircraft identification and the real-time flight data from the first aircraft, terrain data and runway data obtained from a terrain database on board the second aircraft to determine whether the first aircraft is flying too close to water or terrain without being on a flight path towards a runway; and providing the real-time flight data of the first aircraft to a flight data recorder on board the second aircraft in response to the processor of the second aircraft detecting abnormal flight behavior by the first aircraft flying too close to the water or terrain without being on the flight path towards the runway.

9. The method of claim 8, further comprising:

providing a visual indication of a location of the first aircraft on an electronic display of the second aircraft.

10. The method of claim 9, wherein the visual indication includes an indicator that the first aircraft is flying too close to the water or terrain or on an improper path toward the water or terrain.

11. The method of claim 8, wherein the processor on board the second aircraft uses the real-time flight data received from the first aircraft and the terrain data from the terrain database on board the second aircraft to determine whether the first aircraft is flying too close to the water or terrain or on an improper path toward the water or terrain by comparing altitude of the first aircraft is to the terrain data and determining that a runway is not in proximity.

12. The method of claim 11, wherein the processor provides a communication to an air traffic controller or an area controller via an air to ground link upon determining the first aircraft is flying too close to the water or terrain or on an improper path toward the water or terrain.

13. The method of claim 8, wherein a processor provides a user interface element for sending a controller pilot down link (CPDL) message indicating that the first aircraft is flying too close to the water or terrain or on an improper path toward the water or terrain and a squitter message from the first aircraft is no being longer received by the second aircraft.

14. A system, comprising:

a communication interface on board an ownship aircraft for receiving real-time extended squitter messages from an other aircraft in vicinity of the ownship aircraft, the extended squitter messages comprising an aircraft identification and real-time flight data of the other aircraft;

a flight data recorder on board the ownship aircraft;

a flight display on board the ownship aircraft; and a processor on board the ownship aircraft configured to:

determine whether the other aircraft is operating abnormally, based upon the real-time flight data contained in the extended squitter messages from the other aircraft, terrain data obtained from a terrain database aboard the ownship aircraft and runway information identifying any runway in proximity of the other aircraft;

store in the flight data recorder of the ownship aircraft the aircraft identification and real-time flight data of the other aircraft that has been determined by the processor to be operating abnormally; and cause the flight display of the ownship aircraft to display an icon representing location of the other aircraft and indicating that the other aircraft is flying too close to water or terrain or is on an improper path toward the ground.

15. The system of claim 14, wherein the processor applies Terrain Avoidance Warning System (TAWS) rules.

16. The system of claim 14, wherein the real-time flight data of the other aircraft comprises at least one of altitude, aircraft position, direction of flight, airborne velocity, vertical climb/descent, and identification of the other aircraft.

17. The system of claim 16, wherein the processor is part of a traffic collision avoidance system.

18. The apparatus of claim 1, wherein the second aircraft is an unmanned aircraft.

19. The method of claim 8, wherein the second aircraft is an unmanned aircraft.

20. The system of claim 14, wherein the other aircraft is an unmanned aircraft.

21. The system of claim 14, wherein the processor causes a message to be provided in response to the squitter message no longer being received from the other aircraft.

22. The system of claim 21, wherein the message is a controller pilot down link (CPDL) message.

23. The system of claim 21, wherein the message indicates a controlled flight into terrain (CFIT) may have occurred and provides the identification of the other aircraft.

* * * * *